United States Patent [19]

Durchschlag et al.

[11] Patent Number: 4,917,339

[45] Date of Patent: Apr. 17, 1990

[54] REVERSING DEVICE FOR SWIVELABLE RAILS OR MOVABLE FROGS WITHIN THE CROSSING AREA OF A RAILWAY SWITCH

[75] Inventors: Gerald Durchschlag, Zeltweg; Alfred Lang, Weisen; Franz Rotter, Zeltweg; Dieter Fritz, Fohnsdorf; Heinz Kopilovitsch, Hetzendorf, all of Austria

[73] Assignee: Voest-Alpine Maschinenbau Gesellschaft m.b.h., Linz, Austria

[21] Appl. No.: 267,875

[22] Filed: Nov. 7, 1988

[30] Foreign Application Priority Data

Nov. 5, 1987 [AT] Austria ..... 2931/87
Sep. 16, 1988 [AT] Austria ..... 2275/88

[51] Int. Cl.[4] ..... E01B 7/00; E01B 7/16

[52] U.S. Cl. ..... 246/382; 246/387; 246/388; 246/391; 246/469

[58] Field of Search ..... 246/274, 275, 375, 377, 246/379, 382, 385, 387, 388, 389, 390, 391, 392, 415 R, 416, 449, 452, 454, 465, 468, 469, 472; 104/130

[56] References Cited

U.S. PATENT DOCUMENTS

| | | | |
|---|---|---|---|
| 1,049,236 | 12/1912 | Blackburn | 246/377 |
| 1,269,444 | 6/1918 | Hollingshed | 246/469 |
| 3,697,747 | 10/1972 | Edeling et al. | 246/468 |
| 3,860,205 | 1/1975 | Dohse | 246/468 |

FOREIGN PATENT DOCUMENTS

| | | | |
|---|---|---|---|
| 0130783 | 1/1985 | European Pat. Off. . | |
| 328488 | 10/1974 | Fed. Rep. of Germany . | |
| 2534384 | 5/1976 | Fed. Rep. of Germany | 246/454 |
| 0033863 | 3/1905 | Switzerland | 246/385 |

*Primary Examiner*—Andres Kashnikow
*Assistant Examiner*—Timothy Newholm
*Attorney, Agent, or Firm*—Cushman, Darby & Cushman

[57] ABSTRACT

In a reversing device for rails which are swivelable around a swivelling axis, or for movable frogs within the crossing area of a railway switch, the swivelable rails or, respectively, the movable frogs are supported in their position being in alignment with wing rails or, respectively, connecting rails or, respectively, being in contact with such rails by supporting rods extending in the longitudinal direction of the rails and being slideably guided in longitudinal direction of the rails or, respectively, frogs on the sleepers or, respectively, base plates. In this case, the supporting rods are designed as adjusting members for the switch reversal and include at least one thrust support cooperating with thrust supports of the swivelable rails or of the frog, respectively. At least one of the mutually cooperating surfaces of the thrust supports of the rail or, respectively, frog and/or supporting rod is formed of a wedge surface passing over into a supporting surface extending in an essentially parallel relation to the longitudinal direction of the supporting rod and cooperating, in the respective aligned position or, respectively, the contacting position of the rail or, respectively, of the frog, with the thrust support of the rail or, respectively, of the frog.

9 Claims, 4 Drawing Sheets

REVERSING DEVICE FOR SWIVELABLE RAILS OR MOVABLE FROGS WITHIN THE CROSSING AREA OF A RAILWAY SWITCH

BACKGROUND OF THE INVENTION

1. Field of the Invention

The invention refers to a reversing device for rails being swivelable around a swivelling axis or for movable frogs within the crossing area of a railway switch.

2. Description of the Prior Art

Within the crossing area of a railway switch it is possible to obtain a continuous travelling edge in the just desired travelling direction if, for example, wing rails are brought into engagement with a rigid frog, noting that, in dependence on the travelling direction, one of both wing rails is, within the crossing area, brought into contact with the frog and the opposite wing rail is lifted off at the same side of the frog. In principle, it is, for example, from the European Patent Application No. 130 783, already known to use a swivelable rail section in place of a frog, so that, in dependence on the swivelled position of the rail section, a continuous upper edge of the rail is at disposal for travelling over the crossing area in a substantially shock-free manner. For reversing such devices, there have, up till now, been proposed usual adjusting devices being commonly used in switch construction. Such adjusting devices comprise angle levers and push rods and have a relatively complex structure. On account of the great number of articulated joints in such adjusting devices, such adjusting devices can never directly be used for supporting the correct position of movable rails within the crossing area of a railway switch.

In particular, in case of railway switches being travelled upon with high speed, it is of substantial importance to reliably and correctly support the respective selected position of the rail or frog, respectively, within the crossing area of the railway switch. In connection with wing rails, there have already been proposed arrangements comprising supporting rods for maintaining a selected position. In particular AT-PS No. 328 488 shows a switch for Vignoles' rails which comprise a frog and movable wing rails. In this construction, the movable wing rails serve the purpose to avoid any interruption of the travelling edge within the area of the frog, which interruption would detract from the travelling comfort. Supporting of the wing rails in their respective frog-contacting position does, however, not make sure, in this known construction, the maintainance of a required minimum distance for the passage of the wheel flange. In the known construction, a supporting rod was provided for supporting purposes, which supporting rod may extend over several sleepers and thus can provide a supporting effect even in case of length differences resulting from temperature fluctuations. Reversal of the switch was, in this known construction according to the AT-PS No. 328 488, effected in a known and usual manner and the wing rails were also adjusted in an analogous manner.

SUMMARY OF THE INVENTION

The invention now aims at providing a reversing device for rails being swivelable around a swivelling axis or for movable frogs within the crossing area of a railway switch, which device provides the possibility not only to switch over the respective movable parts but simultaneously provides in a reliable manner an effective supporting action for the selected swivelled position and allows one to exactly check the selected swivelled position. For solving this task, the invention essentially consists in that the swivelable rails or movable frogs, respectively, are supported in their position being in alignment with wing rails or, respectively, connecting rails or, respectively, being in contact therewith by supporting rods extending in longitudinal direction of the rails and being slideably guided in longitudinal direction of the rails or, respectively, frogs on the sleepers or, respectively, base plates and in that the supporting rods are designed as adjusting members for the switch reversal and comprise at least one thrust support cooperating with thrust supports of the swivelable rails or of the frog, respectively, noting that at least one of the mutually cooperating surfaces of the thrust supports of rail or, respectively, frog and/or supporting rod is formed of a wedge surface passing over into a supporting surface extending in essentially parallel relation to the longitudinal direction of the supporting rod and cooperating, in the respective aligned position or, respectively, the contacting position of the rail or, respectively, of the frog, with the thrust support of the rail or, respectively, of the frog. On account of using a supporting rod comprising thrust supports, a simple drive means for the reversing device can be realized also in case of complicated swivelable constructional parts of considerable length, the reversing device being suitable for being adapted to the just desired course of the track within the whole length of the respective reversable area. In particular, the use of supporting rods comprising thrust supports not only allows the reversing operation but also supporting of the respective end position of the movement of the movable rail parts within the crossing area, and such a construction provides for a distinct improvement of the support for swivelable parts within the crossing area of a railway switch. In particular, it is possible to obtain by means of such supporting rods and thrust supports a supporting effect and, respectively, adjusting movement at both sides of swivelable or movable parts within the crossing area, so that it becomes possible to use simple rail sections as swivelable parts and as a substitue for frogs of complicated shape and to travel, in spite thereof, along such tracks with high speed. In principle, frogs of most different construction may be used in railroad tracks. There are, for example, known monoblock frog castings which may, in a simple manner, be swivelably mounted and may be supported in the respective swivelled position in both directions by means of such a reversing device. In arrangements of frogs comprising a main tip and an auxiliary tip there can, in addition, be obtained the advantage that one of both connecting rails adjoining the frog can be welded to the frog, i.e. to its main tip, so that an additional interruption of the travelling edge is avoided. The exact adjustment made possible by such thrust supports provides the possibility to reliably maintain the distance required for the passage of the wheel flange when swivelling such frogs. In contrast to usual reversing devices, which must laterally extend through the railroad bed in an outward direction, temperature fluctuations are without substantial influence on the exactness of the selected adjustment, because long rods are, of course, subject to greater length variations in case of temperature fluctuations than thrust supports of small size. On account of providing an area extending in substantially parallel relation to the existing travelling direction, the just selected reversed position is reliably and effectively locked.

The reversing device according to the invention can be used in a particularly advantageous manner in connection with movable rails within the crossing area, for which purpose the arrangement is preferably such that the movable rail within the crossing area is formed of a swivelably supported rail section having its swivelling axis extending in essentially normal direction to the longitudinal axis of the rail arranged between the free ends of the rail section, noting that thrust supports are arranged at both sides of the swiveling axis and of the rail section for swivelling the rail section and securing its end position. In connection with such movable, in particular swivelably supported rail sections, it was up till now known to arrange the swivelling bearing in proximity of one end of the swivelable rail section, which resulted in a high stress of the bearing location within the area of transition onto the travelling edge of the adjoining connecting rails. On account of the swivelling axis of the movable rails being, according to the invention now arranged between both free ends of the movable rail section, there results, when using thrust supports arranged at both sides of the swivelling axis and of the rail section, the possibility to exactly position the connection at both sides of the movable rail section, so that there results an increased travelling comfort. On account of said thrust supports again being equipped with, beside with the wedge surfaces for swivelling the rail section, the supporting surfaces extending in essentially parallel relation to the longitudinal direction of the rail, such crossing areas can be passed through with increased speed without requiring therefor within the crossing area of the railway switch constructional parts of bigger size. The reliable supporting within the existing swivelled position and the possibility to adapt the length of the rail area to be switched or, respectively, to be swivelled according to the requirements, provides the possibility to produce railway switches for highest speeds. In this case, the arrangement can advantageously be selected such that within a crossing area formed of a rail section being swivelable around a swivelling axis, there are arranged at both sides of the swivelling axis inclined surfaces of the thrust supports with mutually opposite inclination, so that drive means of small size and small power make sure reliable adjustment of the rail section.

The reversing device can, however, in a simple manner, also be used for frogs being supported for being swivelable around a swivelling axis, because also in this case the frog tip is reliably secured and supported in both directions and maintainance of the required minimum distances of the rail sections being lifted off can be warranted in a particularly simple manner.

The reversing device comprising supporting rods and thrust support makes, however, possible also other novel arrangements within the crossing area of a railway switch, by means of which arrangements the travelling comfort and the capability of being travelled upon with high speed can reliably be maintained also in case of beginning wear phenomenae. For this purpose, the arrangement is advantageously selected such that the frog tip is supported for being shiftable in the longitudinal direction of the rail and is resiliently held in contact on a respective one rigid wing rail or connecting rail and that the thrust supports for reversing the frog in transverse direction to the action line of the spring hold that end of the frog tip, which is located opposite the resilient contact, in contact with that connecting rail or, respectively, wing rail, which is located, in travelling direction. It is in particular such a resilient contact on wing rails or connecting rails which is only made possible by using a reversing device comprising supporting rods and thrust supports, because it is only such an arrangement which provides the possibility to support the frog for limited shifting movement in longitudinal direction of the rail. In a usual adjustment without unambiguous definition of the respective shifted position in both directions and without supporting means for the end position just to be maintained, such an axially shiftable mounting and resilient mounting of a frog is not easily controlable.

A further reduction of the number of constructional parts required for driving the reversing device can be obtained if at both sides of a supporting rod there are arranged thrust supports having the supporting surfaces extending essentially in parallel relation to the longitudinal direction of the supporting rod arranged in a staggered manner relative to the longitudinal direction of the supporting rod. In such an arrangement, one can do with one single supporting rod, said supporting rod being suitable for acting as a position securing means in both directions transverse to the longitudinal axis of the rail. Alternately, the arrangement can, for the purpose of reducing the expenditure for the drive means, be selected such that the thrust supports being connected with a supporting rod comprise cranked ledges extending in transverse relation to the longitudinal axis of the supporting rod and cooperating with their flanks facing the thrust support and being averted therefrom with at least one counter stop, in particular roller, of the thrust support of the swivelable rail or, respectively, of the movable frog.

In particular, when connecting movable connecting pieces to rigid frogs or for simultaneously actuating two wing rails, the arrangement can advantageously and in a manner known per se be selected such that the thrust supports act on coupling members of mutually associated movable rails. In particular, in case of more complex arrangements comprising a rigid frog, the arrangement can, according to the invention, be selected such that movable wing rails and movable connecting rails are connected to a stationarily supported frog having, as seen in a top plan view, substantially the shape of a parallelogram and have their front surfaces located adjacent the frog adapted to extend, in the respective frog-contacting position, in essentially parallel relation to the adjacent edge of the frog, noting that a connecting rail and a wing rail are adapted to be alternately pressed, in longitudinally aligned position, against the frog via thrust supports and the respective other wing rail and the connecting rail being essentially in alignment with this wing rail are secured in their respective position by thrust supports, thereby maintaining a predetermined distance for the passage of the wheel flange.

The use of supporting rods simultaneously provides the advantage that the position may exactly be monitored, for which purpose can be used, in a known and usual manner, inductive or capacitive proximity switches. On account of the relatively great shifting stroke of such supporting rods as compared with the relatively small adjustment path to be covered by means of the reversing device, there results a high precision in sensing the desired end position, noting that, with consideration of the thrust support areas extending substantially in parallel relation to the longitudinal direction of the rail such position report simultaneously gives an information on the safety of the supporting means.

BRIEF DESCRIPTION OF THE DRAWINGS

In the following, the invention is further explained with reference to embodiments shown in the drawings. In the drawings.

DETAILED DESCRIPTION OF THE PREFERRED EMBODIMENTS

Figure 1:
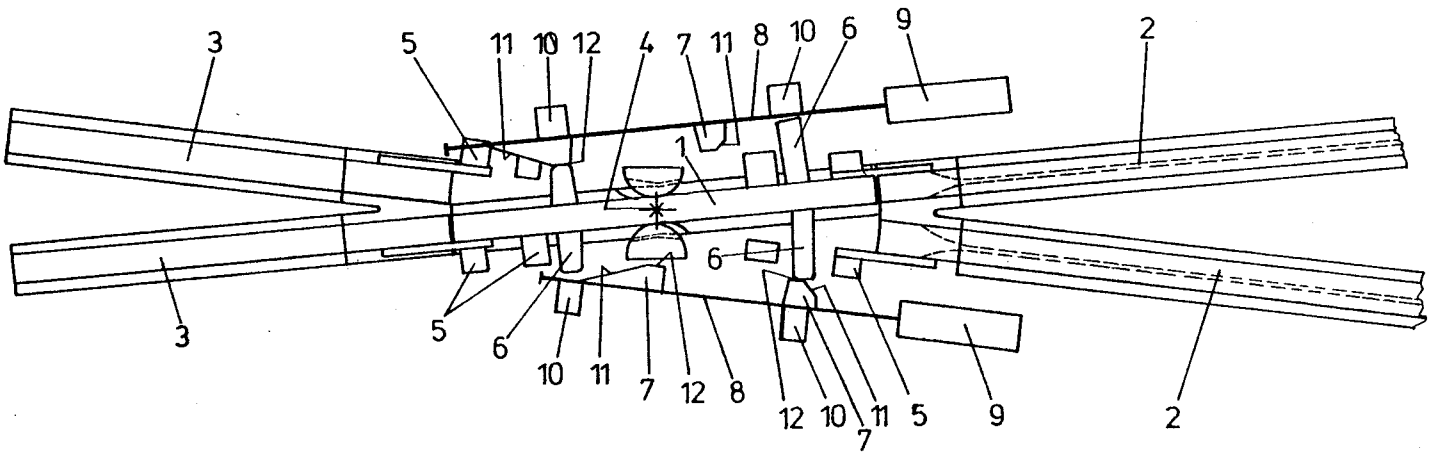
FIG. 1 shows an embodiment of a reversing device according to the invention for a rail being swivelable around an axis within the crossing area.

In FIG. 1, there is shown a swivelably supported rail section being designated by the reference numeral 1 and selectively adjoining rigid wing rails 2 and rigid wing rails 3. The swivelable rail section 1 is swivelable around an axis extending in essentially normal relation to the longitudinal axis of the rail and is schematically indicated by the reference numeral 4, noting that the swivelling axis 4 is provided within a central area between the free ends of the rail section 1. For exactly positioning the rail section 1 in the respective end positions, there are provided rigid supporting members 5 which are, like the bearing means of the rail section 1 as well as of the immediately adjoining area of the wing rails 2 and, respectively, of the connecting rails 3, fixed on a plate member or, respectively, trough, not shown in detail. Thrust supports 6 for reversing the rail section and for fixing same in position are provided on the rail section 1 and cooperate with thrust support 7 of a supporting rod 8, the drive means for which is indicated by the reference numeral 9. The supporting rod 8 is supported within guide means schematically indicated by the reference numeral 10 and again being connected with the base plate or trough, respectively, of the crossing. The thrust supports 7 arranged on each supporting rod 8 each comprise wedge surfaces 11 passing over into a supporting surface 12, each extending in essentially parallel relation to the longitudinal direction of the supporting rod 8, noting that the rail section is reliably fixed in the selected position by the fact that the supporting surface 12 extending in essentially parallel relation to the longitudinal direction of the supporting rod contacts the thrust support 6 connected with the rail section 1. The thrust supports 7 comprise at both sides of the swivelling axis 4 inclined surfaces 11, so that reversal of the rail section 1 in both end positions is possible when moving the supporting rod 8 in a longitudinal direction. In FIG. 1, there are provided supporting rods, comprising thrust supports, at both sides of the movable rail section 1 for reliably supporting the movable rail section over the whole length. For reversing purpose, the thrust supports are arranged such that the lock achieved by cooperation of the parallel supporting surface 12 with the thrust support 6 of the rail is cancelled first prior to provoking reversing movement by the running up of the corresponding wedge surfaces 11 onto the thrust supports provided on the other end side of the movable rail section. As drive means 9 for the supporting rods 8 there can, for example, be used electric lifting motors or hydraulic cylinders.

Figure 2:
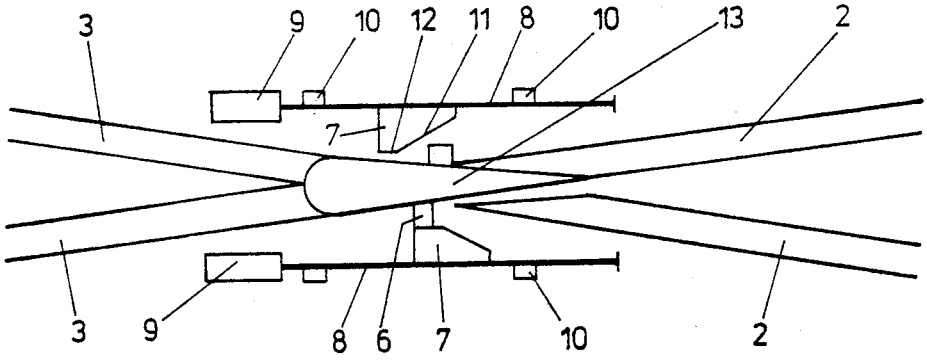
FIG. 2 shows another embodiment of the reversing device according to the invention for a movable frog within the crossing area.

In FIG. 2, there is shown a reversing device for a movable frog within the crossing area. The rigid wing rails are there again designated by 2 and the rigid connecting rails are designated by 3. The frog 13 is reversed by supporting rods 8 comprising thrust supports 7 when moving the supporting rods 8 in longitudinal direction thereof, noting that locking of one position is again effected by a cooperating action between the supporting surface 12, extending in substantially parallel relation of the supporting rod 8, of the thrust support 7 with thrust supports 6 on the frog. When effecting a reversing operation, there must again be made provision for first cancelling the lock caused by the contact of the supporting surface 12 on the thrust support 6 of the frog tip 13 prior to causing reversal of the frog tip into the second position contacting a wing rail 2 by the cooperating action between the wedge surface 11 of the supporting rod 8 arranged on the other side of the frog tip 13 with the corresponding thrust support 6.

Figure 3:
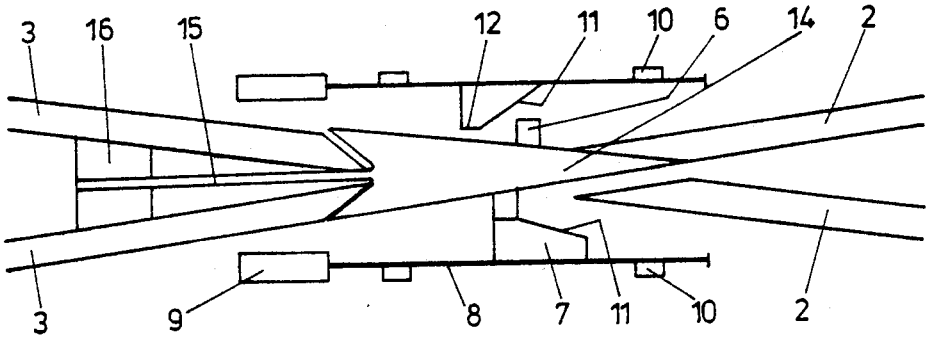
FIG. 3 shows a modified embodiment of a movable frog within the crossing area, together with a reversing device according to the invention.

In FIG. 3 there is shown a modified, as compared with FIG. 2, embodiment of a frog tip 14 being shiftably supported in longitudinal direction of the rail and being held in resilient contact on a respective rigid wing rail 2 by a spring 15 being in connection with the connecting rails 3 via a support member 16. Reversal of this frog 14 is effected, analoguous to the reversal of the frog of FIG. 2, via supporting rods 8 comprising thrust supports 7 equipped with wedge surfaces 11 and supporting surfaces 12 and providing in the respective end positions a reliable lock of the frog tip 14 on account of the cooperation between the support surface 12 extending in parallel relation to the longitudinal direction of the supporting rod 8 and the thrust supports arranged on the frog tip 14.

In place of resiliently supporting the frog tip 14 on the rigid connecting rails 3, the frog tip can also be resiliently supported on the rigid wing rails 2, thereby effecting reversal of the frog tip and locking same in contact with the corresponding connecting rail by means of reversing devices comprising supporting rods as well as thrust supports equipped with wedge surfaces and with supporting surfaces extending in parallel relation to the supporting rods.

Figure 4:
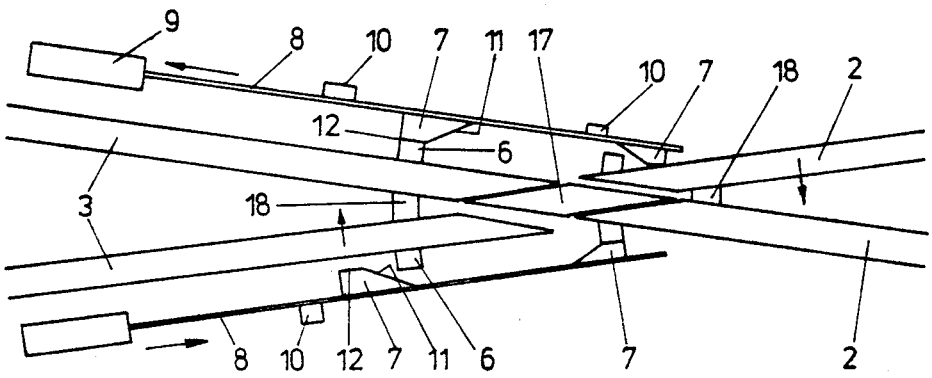
FIG. 4 shows an embodiment of the reversing device according to the invention for connecting rails or, respectively, wing rails alternately contacting a frog.

In the embodiment shown in FIG. 4, there is provided a rigid frog 17 having, as seen in a top plan view, essentially the shape of a parallelogram and being adjoined by movable wing rails 2 as well as by movable connecting rails 3. For the purpose of reversing the contacting wing rails 2 and, respectively, connecting rails 3, there are again provided supporting rods 8 equipped with thrust supports 7 comprising wedge surfaces 11 as well as supporting surfaces 12 extending in essentially parallel relation to the longitudinal direction of the supporting rod, said thrust supports 7 cooperating with thrust supports 6 of the rails 2 and 3, respectively. For the purpose of simultaneously reversing mutually associated wing rails and connecting rails, the wedge surfaces at both sides of the central area of the frog 17 are designed with mutually opposite direction. For the purpose of coupling the wing rails 2 and the connecting rails 3, respectively, there are provided connecting rods 18, so that by reversing a rail at one side of the frog the other rail coupled therewith is, by being taken along, lifted off from the other contacting surface of the frog.

The guide means 10 for the supporting rods can be formed of angle sections being connected with the common base plate or trough, respectively, of the crossing area, noting that for the purpose of reducing the friction forces when moving the supporting rods a roller bearing means may be provided in these guide means. For the purpose of reducing during reversing operation the friction of the thrust support 6 of the rails on the wedge surfaces 11, there can be, for example, provided rollers within the area of the contacting surface of the thrust support 6, noting that wedge surface shapes deviating from the straight-lined wedge surface 11 may be selected for facilitating the rolling movement of such rollers. Furthermore, the thrust supports 6 can be chamferred within a partial area being inclined to the wedge surfaces 11, whereby the friction during reversing operation is again reduced.

Figure 5:
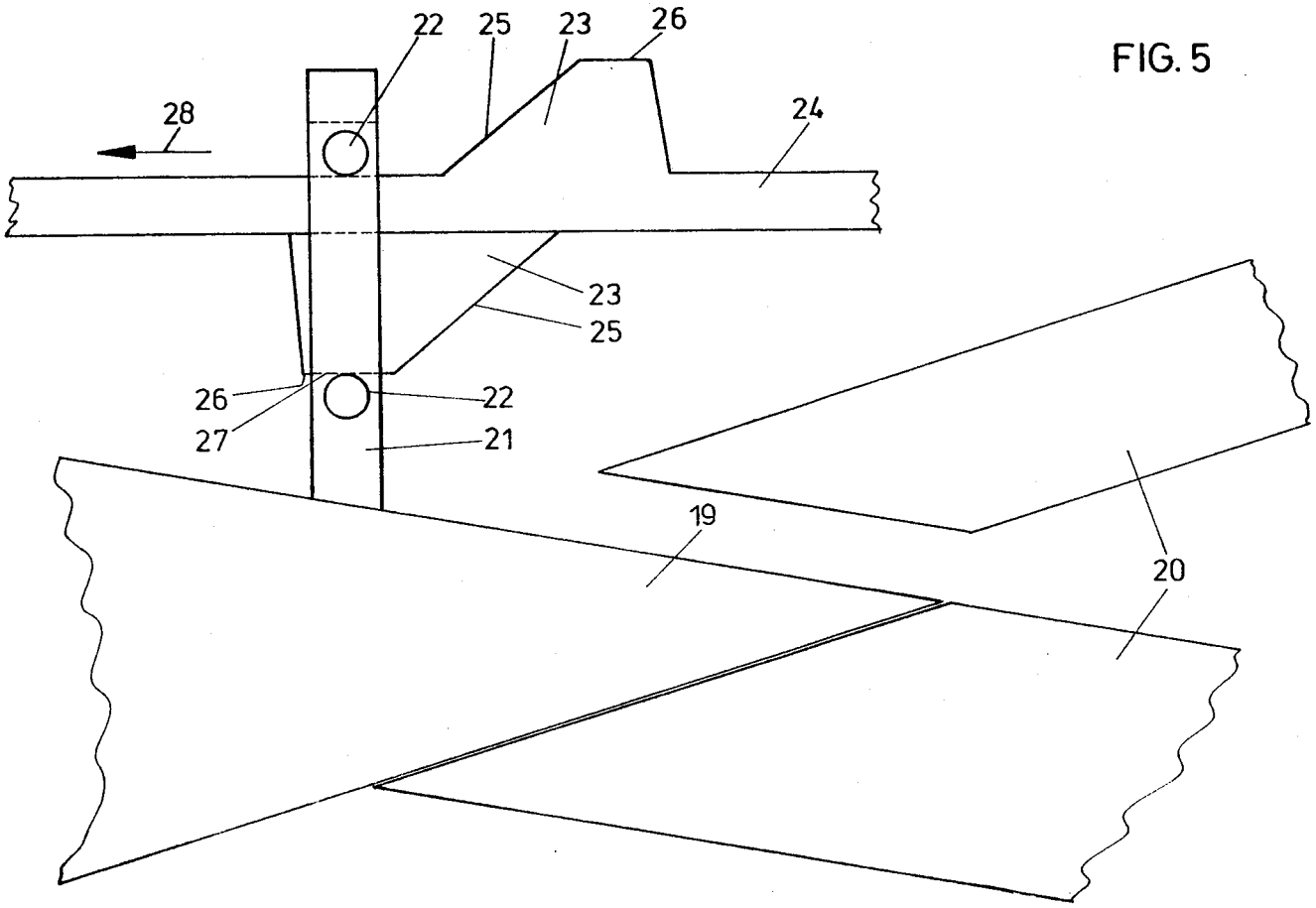
FIG. 5 shows an embodiment of the reversing device, in an enlarged scale, comprising thrust supports at both sides of the supporting rod

In FIG. 5 there is shown in an enlarged scale as compared with the previous figures, a partial area, designated by the reference numeral 19, of a movable frog contacting a wing rail 20. A thrust support 21 is connected with the frog tip 19 and has supported therein rollers 22 which cooperate with thrust supports 23 of a supporting rod 24 being movable only in longitudinal direction of the rail. The thrust support 23 comprise again wedge surfaces 25 as well as supporting surfaces 26 extending in parallel relation to the supporting rod 24. In the position shown in FIG. 5, locking of the tongue rail is effected by the cooperation of the supporting surface 26 facing the frog tip 19 with a stop surface 27 provided in the plane of the corresponding roller 22. For the purpose of opening or reversing, respectively, the frog tip, there is , when moving the supporting rod 24 in direction of the arrow 28, first effected disengagement of the mutually contacting surfaces 26 and 27, whereupon subsequently the roller 22 located at a greater distance from the frog tip comes into engagement with the outwardly located wedge surface 25 and draws the rail or the frog tip 19, respectively, out of the contacting position and moves this rail or frog tip in contact with the second rigid rail 20. In case of such an embodiment of a twin arrangement of thrust supports, one can do without arranging the reversing device at both sides of a movable frog tip, because reversing movement and locking in both contacting positions is effected via the thrust supports 23 arranged at both sides of the supporting rod 24.

Figure 6:
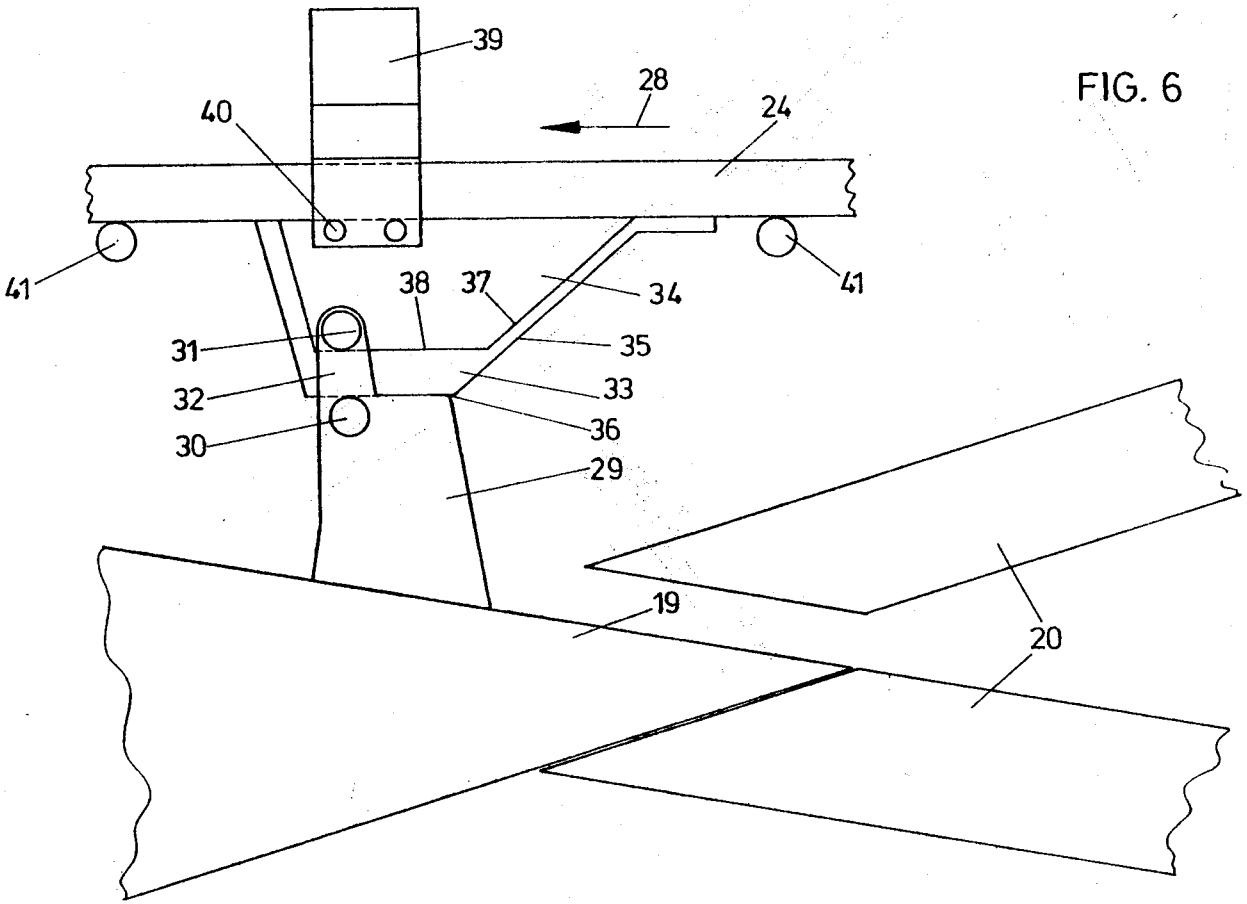
FIG. 6 shows, in analogism to FIG. 5, a modified embodiment of a twin-arrangement of thrust supports.

In the embodiment according to FIG. 6, the movable frog tip 19 is again shown in a position contacting a wing rail 20, the frog tip being connected with a thrust support 29. The thrust support 29 comprises rollers 30 and 31 being supported within a protrusion 32 of the thrust support 29 and embracing a ledge 33 being connected with a thrust support 34 in its turn being connected with the supporting rod 24. In this case, the ledge 33, which for example extends outward of the plane of the supporting rod 24, has a first wedge surface 35 passing over into a first supporting surface 36 extending essentially in parallel relation to the longitudinal direction of the supporting rod 24 and having cooperating therewith the roller 30, and has a second wedge surface or, respectively, inclined surface 37 passing over into a second supporting surface 38. When moving the supporting rod 24 in direction of the arrow 28 for the purpose of opening or, respectively, reversing the movable frog tip 19, the roller 30 first comes out of engagement with the supporting surface 36, whereupon the frog tip 19 is, on account of the cooperation of the roller 31 with the second wedge surface 37 of the ledge, lifted off the one rail 20 and is moved in contact position with the second rail. For the purpose of guiding the supporting rod 24, there is provided a guide means 39 being connected with rails (not shown in detail) and comprising guide rollers 40 for frictionless sliding movement of the supporting rod 24, noting that for increasing the guiding effect there are indicated further guide rollers 41. Also in this case, one can do with only one such supporting rod for reversing the railway switch, because, also in the embodiment shown in FIG. 6, reversal movement as well as a simultaneous locking movement in the second end position is achieved on account of the design and arrangement of the wedge surfaces and supporting surfaces.

In place of the movable frog tip 19 shown in the FIGS. 5 and 6, there can, of course be reversed and be locked in both end positions a swivelable or, respectively, movable rail section by means of only one such twin-arrangement of thrust supports.

What is claimed is:

1. A reversing device for a rail crossing site, comprising:

two wing rails which converge at an acute angle towards a crossing site;

two connecting rails which diverge at an acute angle away from the crossing site;

one of the connecting rails being arranged to provide part of a first longitudinal continuation of one of the wing rails, and the other of the connecting rails being arranged to provide part of a second longitudinal continuation of the other of the wing rails;

a rail element disposed at said crossing site and arranged to alternatively provide a further part of said first longitudinal continuation which includes said one wing rail and one connecting rail or a further part of said second longitudinal continuation which includes said other wing rail and said other connecting rail;

means for shifting a structure comprising one of:

(a) said rail element; and (b) said two wing rails and said two connecting rails, between a first position and a second position, for alternatively establishing said first longitudinal continuation while disrupting said second longitudinal continuation, and establishing said second longitudinal continuation while disrupting said first longitudinal continuation;

said means for shifting said structure between said first position and said second position, comprising:

at least one supporting rod extending generally longitudinally of said wing rails and connecting rails beside said rail element;

guide means supporting each said supporting rod for reversible longitudinal movement;

drive means for reversibly longitudinally moving each said supporting rod in the respective said guide means between a first position and a second position;

each said structure having secured thereon and projecting generally transversally therefrom for interaction with a respective said supporting rod at least one structure-based thrust support having support surface means;

each support rod having secured thereon and projecting generally transversally therefrom for interaction with said structure at least one support rod-based thrust support having a wedge surface leading to a support surface, each said support surface being disposed in a substantially vertical plane as seen in plan view, which plane is substantially parallel to the longitudinal axis of the respective said support rod;

each support rod-based thrust support being so located on a respective said support rod, in relation to a respective said structure-based thrust support, that, in sequence as said structure is being shifted by longitudinally moving each said support rod, to provide as a new position either said longitudinal continuation from providing as an existing position the respective other said longitudinal continuation:

(a) a said support surface of a said support rod-based thrust support which is in engagement with a said support surface means of a said structure-based thrust support is moved out of engagement therewith so as to free said structure from being fixed in said existing position and able to be shifted towards said new position; and (b) a said wedge surface of a said support rod-based thrust support is progressively moved along a said support surface means of a said structure-based thrust support so as to cam said structure away from said existing position and into said new position, until the said support surface into which such wedge surface leads becomes engaged with said support surface means of the last-mentioned structure based thrust support thereby fixing said structure in said new position.

2. The reversing device of claim 1, wherein:

said structure is said rail element, and said rail element is a rail section having two longitudinally opposite free ends, said rail section being mounted for swivelling movement about a vertical axis located intermediate said free ends;

two said supporting rods are provided, one each beside opposite sides of said rail element;

said rail section has secured thereon four said structure-based thrust supports, including two located respectively before and after said vertical axis with longitudinal spacing from one another and projecting towards one said supporting rod, and two located respectively before and after said vertical axis with longitudinal spacing from one another and projecting towards the other said supporting rod;

said structure-based thrust supports being so located that the support surface means of one diagonally opposite subset of two thereof is engaged with respective support surfaces of respective support rod-based support surfaces when said rail section is fixed in said existing position, and the support surface means of another diagonally opposite subset of two thereof is engaged with respective support surfaces of respective support rod-based support surfaces when said rail section is fixed in said new position.

3. The reversing device of claim 2, wherein:

on each said support rod, the wedge surfaces on the respective two support rod-based thrust supports are inclined in longitudinally opposite directions relative to one another.

4. The reversing device of claim 1, wherein:

said structure is a rail element and said rail element is a frog having a base and a tip, said frog being mounted for pivotal movement about a vertical axis so that said top moves laterally in opposite directions relative to said base.

5. The reversing device of claim 4, wherein:

said frog is mounted for said pivotal movement by resilient spring means having one fixed end and an opposite end connected to said frog base.

6. The reversing device of claim 1, wherein:

said at least one support rod is constituted by one support rod having two of said support rod-based thrust supports secured thereon, projecting in laterally opposite directions from said support rod, staggered longitudinally out of correspondence with one another and having said wedge surfaces thereof oriented in longitudinally opposite directions.

7. The reversing device of claim 1, wherein:

said at least one support rod-based thrust support comprises two said thrust supports extending laterally in the same direction from a said support rod, with respective wedge surfaces thereof facing in laterally opposite directions and respective support surfaces thereof facing in laterally opposite directions;

and said at least one structure-based thrust support comprises a thrust support having said support surface means thereof provided by two opposed rollers mounted thereon and engaged with respective of said two support rod-based thrust supports so as to run on said wedge surfaces and on said support surfaces of said two support rod-based thrust supports.

8. The reversing device of claim 1, wherein:

said rail element is a rigid frog and said structure is two wing rails and two connecting rails, said two wing rails being mounted for joint lateral movement near said rigid frog into alternative longitudinal continuation therewith, and said two connecting rails being mounted for joint lateral movement near said rigid frog into alternative longitudinal continuation therewith.

9. The reversing device of claim 8, wherein:

said rigid frog is parallelogram-shaped in top plan view, so as to have four angled sides, and said two wing rails and said two connecting rails each have angled ends oriented for end-to-side engagement with respective sides of said rigid frog when alternatively pressed thereagainst in diagonally opposite twos, in use.

* * * * *